US005671990A

United States Patent [19]

Teasdale

[11] Patent Number: 5,671,990

[45] Date of Patent: Sep. 30, 1997

[54] LOCKER SHELF APPARATUS

[76] Inventor: Mark H. Teasdale, 4069 Brockton Crescent, North Vancouver, British Columbia, Canada, V7G 1E5

[21] Appl. No.: 603,373

[22] Filed: Feb. 20, 1996

[51] Int. Cl.[6] ..... A47B 95/00

[52] U.S. Cl. ..... 312/351; 248/318; 108/149

[58] Field of Search ..... 312/245, 319.7, 312/351, 352; 211/113, 118; 248/303, 317, 318, 328, 322; 108/149

[56] References Cited

U.S. PATENT DOCUMENTS

| | | | |
|---|---|---|---|
| 1,928,731 | 10/1933 | Mattson | 211/113 |
| 2,306,266 | 12/1942 | Heim | 108/149 |
| 3,712,696 | 1/1973 | McDonnell | 312/253 |
| 4,537,451 | 8/1985 | Bredderman et al. | 312/6 |
| 4,808,875 | 2/1989 | Edwards | 312/245 |
| 5,137,160 | 8/1992 | Santucci | 211/153 |
| 5,221,013 | 6/1993 | Santucci | 211/153 |
| 5,251,973 | 10/1993 | Hazan | 312/257.1 |

FOREIGN PATENT DOCUMENTS

| | | | |
|---|---|---|---|
| 820180 | 8/1969 | Canada . | |
| 1318343 | 5/1993 | Canada . | |
| 2508294 | 12/1982 | France | 312/319.7 |

*Primary Examiner*—Peter M. Cuomo
*Assistant Examiner*—Gerald A. Anderson
*Attorney, Agent, or Firm*—Norman M. Cameron

[57] ABSTRACT

A locker shelf apparatus includes a platform shaped to fit horizontally within a locker. There are three support members connected to the platform at spaced-apart positions. There are loops or the like on each support member for engaging hooks in the locker above the platform. Preferably there is a drawer slidably mounted below the platform.

16 Claims, 4 Drawing Sheets

LOCKER SHELF APPARATUS

BACKGROUND OF THE INVENTION

Lockers are commonly provided in schools, universities, gyms and places of work for individuals to store clothing, books and other personal effects. Often however the lockers do not have a sufficient number of individual storage compartments. They frequently have a shelf near theirs tops and large storage spaces beneath which are not subdivided. There is normally a coat hook on the back and each side of a locker within the storage compartment. This presents difficulties in conveniently storing small articles, often leading to a disorderly appearance and difficulty in retrieving any particular desired item.

It would be relatively easy to design such lockers with more storage compartments, but this does not address the problem of pre-existing units which cannot be readily modified by an individual user.

Temporary shelves for locker interiors have been suggested in the past, for example as shown in U.S. Pat. No. 4,537,451 to Bredderman et at. In this patent a storage device is hung from the conventional shelf near the top of the locker. However it is a relatively bulky apparatus, particularly when installed.

U.S. Pat. No. 4,808,875 to Edwards discloses a locker shelf assembly which is suspended above the floor of the locker.

U.S. Pat. No. 5,251,973 to Hazan discloses a shelving unit for placement at the bottom of a storage locker including shelf-members with U-shaped hook members on opposed sides adapted to engage pairs of closely vertically spaced horizontal rods.

U.S. Pat. Nos. 5,137,160 and 5,221,013, both to Santucci disclose add-on shelves for athletic or school lockers.

U.S. Pat. No. 3,712,696 to McDonnell discloses a shelf-supported drawer arrangement.

Canadian Patent No. 1,318,343 to Russett et al. discloses an adjustable locker shelf including a drawer.

Canadian Patent No. 820,180 discloses a combination drawer and writing shelf.

These prior art devices have not gained widespread popularity for a variety of reasons. Many of them are relatively bulky or expensive, particularly for students.

Accordingly it is an object of the invention to provide a locker shelf apparatus which is economical to produce and sell.

It is another object of the invention to provide an improved locker shelf apparatus which can be installed easily without special tools and without interfering with most of the space in the locker.

It is a further object of the invention to provide an improved locker shelf apparatus which is convenient to use and provides good storage for relatively small items.

SUMMARY OF THE INVENTION

In accordance with these objects, there is provided a locker shelf apparatus which includes a platform shaped to fit horizontally within a locker. There are three support members connected to the platform at spaced-apart positions. Each support member has means for engaging hooks in the locker above the platform. The support members may be elongated, flexible members. The means may be a loop on each support member.

Preferably the platform has a drawer slidably mounted thereon. The drawer may be below the platform.

Locker shelf apparatuses according to the invention may be made of inexpensive, lightweight materials such as rigid plastic, millboard, chipboard or corrugated cardboard. They can be shaped to fit easily within most lockers and mounted in the matter of seconds. They can be produced economically enough to be regarded as essentially disposable at the end of a period of usage such as a school term. Alternatively they can be made of higher grade materials. They can have drawers which provide a convenient storage location for small items which can easily become lost. They also provide support and storage near eye level which is particularly important for many users.

DESCRIPTION OF THE PREFERRED EMBODIMENTS

Figure 1:
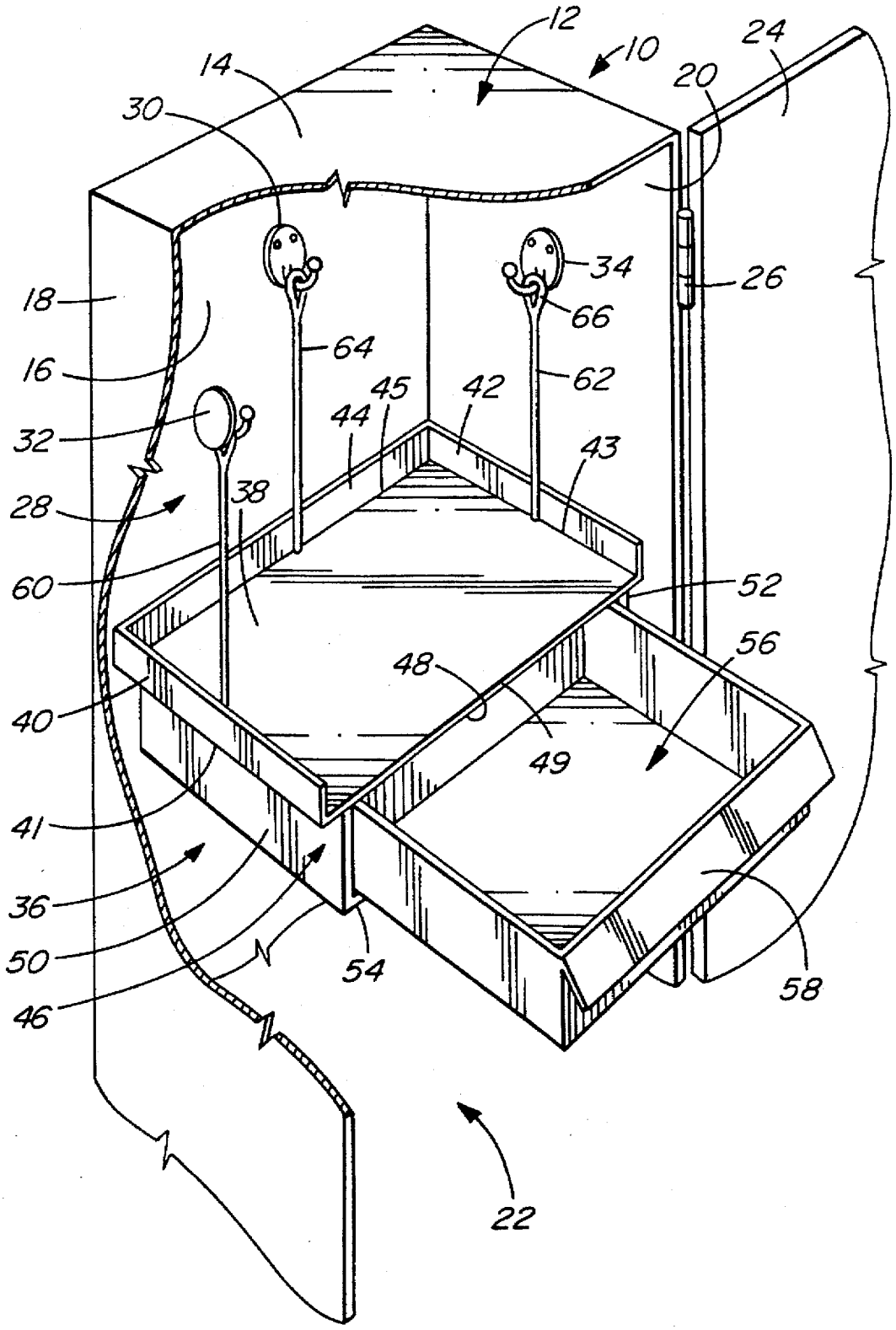
FIG. 1 is a top, front isometric view of a locker with a locker shelf apparatus mounted therein according to an embodiment of the invention, the locker being shown in fragment and partly broken away.

Referring first to FIG. 1, this shows a conventional locker 10 including a cabinet 12 having a top 14, a back 16 and opposite sides 18 and 20. There is an open front 22 having a door 24 hingedly mounted thereon by a plurality of hinges 26, only one of which is shown. The locker has an inside 28. Coat hooks 30, 32 and 34 are mounted inside the locker on the back 16 and sides 18 and 20 respectively. As described so far, the locker is conventional and therefore is not described in more detail.

There is a locker shelf apparatus 36 mounted within the locker. The apparatus includes a platform 38 which is slightly narrower than the distance between sides 18 and 20 of the locker and shallower than the distance between its front 22 and its back 16 so as to fit horizontally within the locker as illustrated. The platform in this example has upstanding flanges or edges 40, 42 and 44 along its opposite sides 41 and 43 and back 45 respectively. Alternatively these could be omitted or there could also be a similar flange along front 49 of the platform.

The platform has a cradle 46 connected to bottom 48 thereof. The cradle has opposite, spaced-apart sides 50 and 52 and a bottom 54 which is spaced-apart from bottom 48 of the platform. The platform, flanges and cradle can be formed as a single member from rigid plastic, for example. Alternatively they may be separate components connected together by adhesive or some other fastening means.

There is a drawer 56 located slidingly within the cradle. The drawer is box-shaped with an open top and a has a flap 58 on the front thereof in this example which serves as a handle to open and close the drawer. The drawer is shown opened in FIG. 1. It is closed by pushing it into the cradle so it is entirely below the platform.

There are three support members 60, 62 and 64 connected to the platform adjacent its sides 41 and 43 and back 45 respectively. Support member 64 is adjacent the center of the back of the platform. As may be seen, these locations generally correspond to positions below the coat hooks 32, 34 and 30 respectively. Each support member in this example is a tension member of a flexible material, such as a flexible plastic and has a loop 66 formed on the top thereof as seen for support member 62. The loops fit over the hooks and support the platform and accordingly the cradle and drawer.

Figure 2:
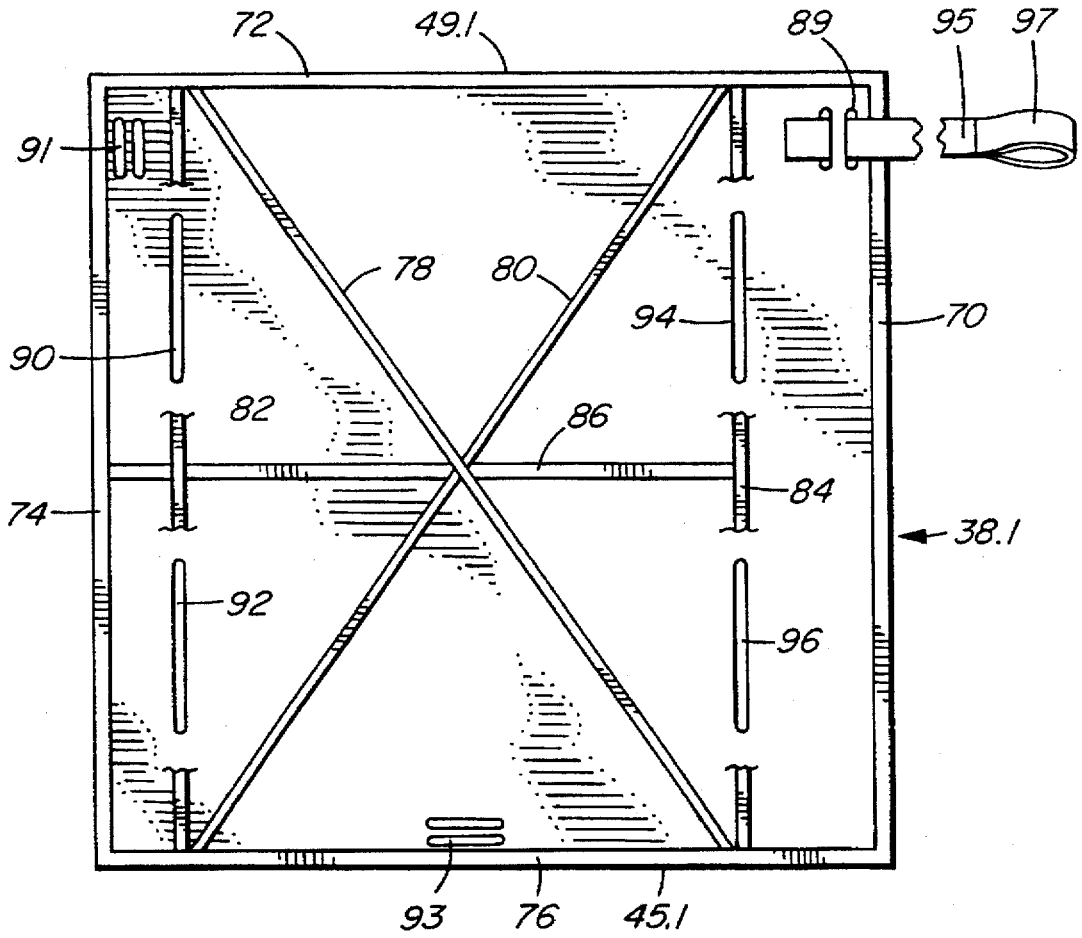
FIG. 2 is a bottom plan view of a platform of a locker shelf apparatus according to an alternative embodiment of the invention.
Figure 3:
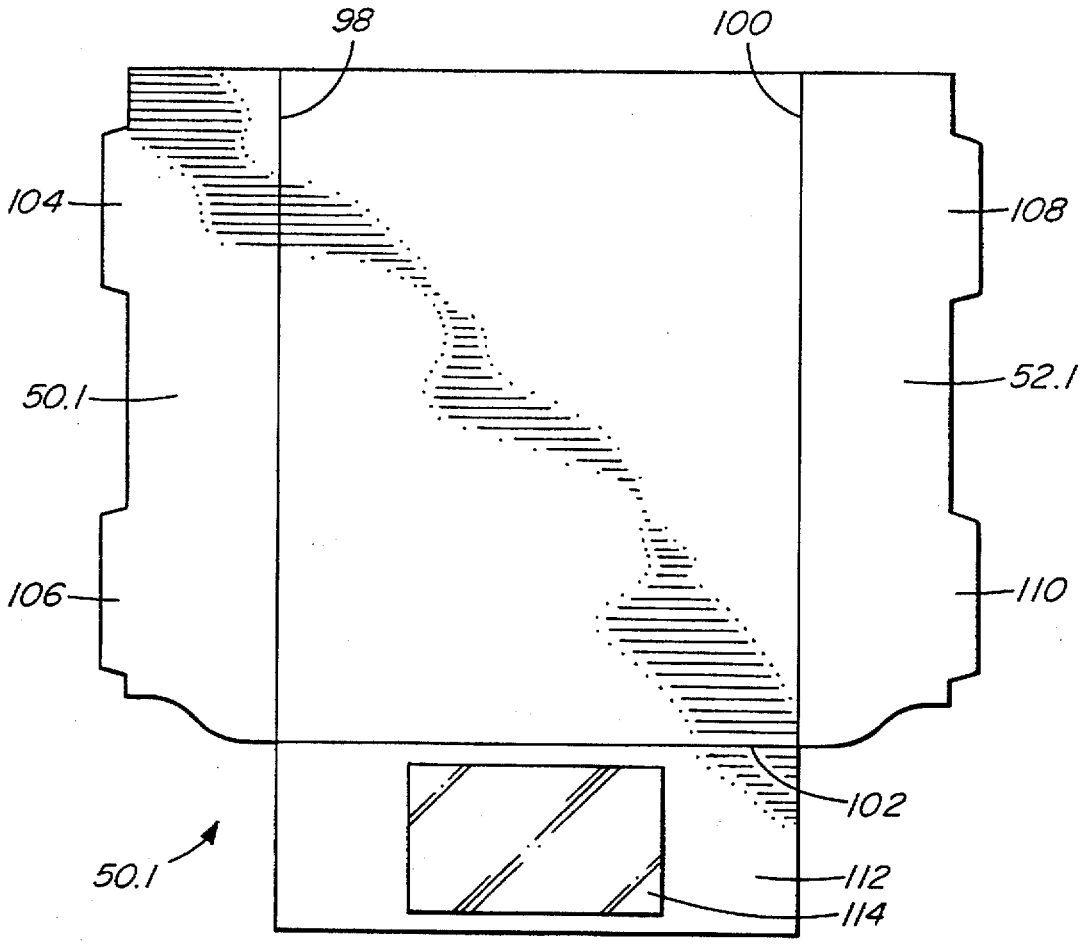
FIG. 3 is an unfolded, plan view of a drawer support cradle for the embodiment of FIG. 2.
Figure 4:
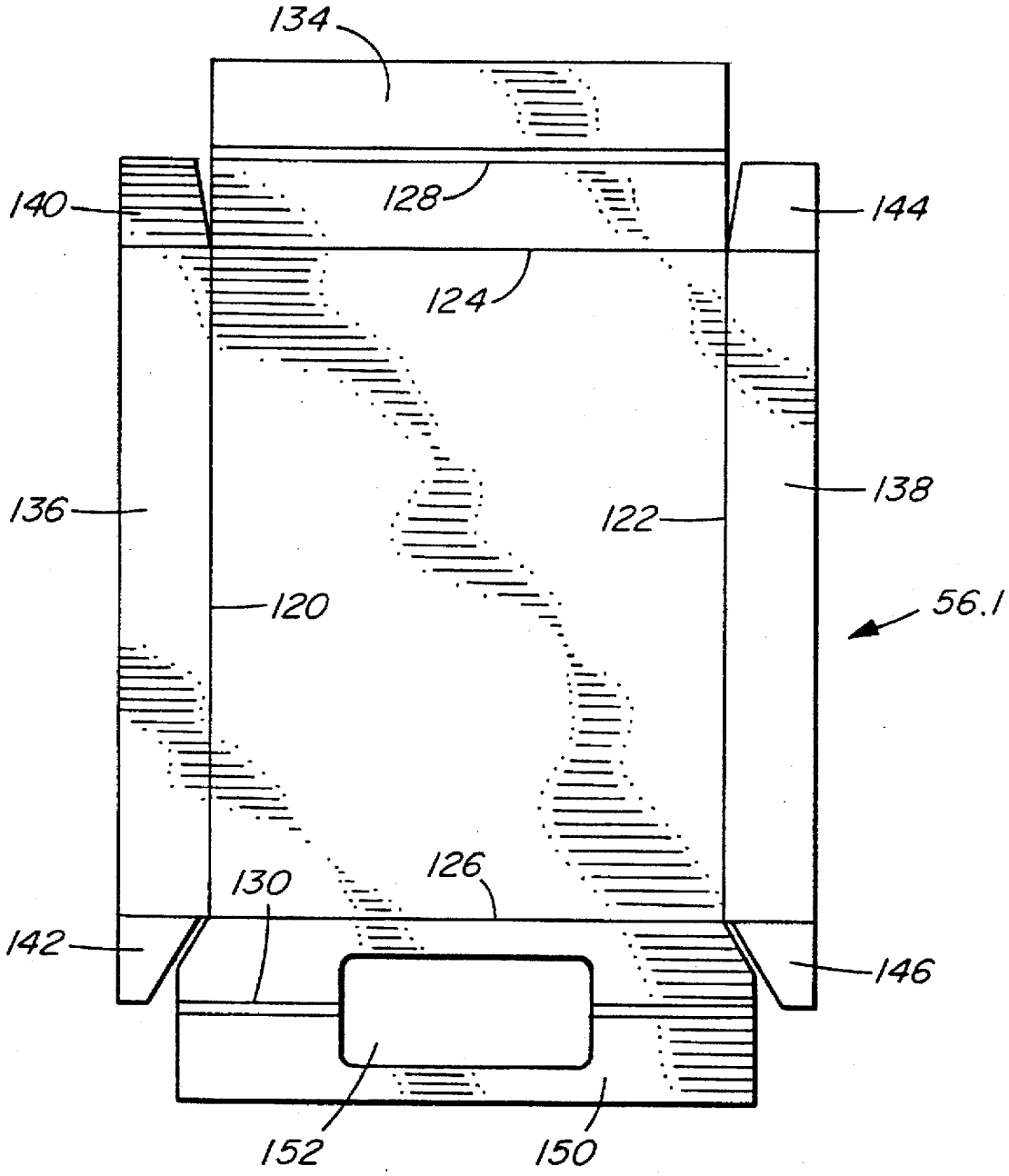
FIG. 4 is an unfolded, plan view of a drawer for the embodiment of FIG. 2 and 3.

FIG. 2–4 illustrate an alternative embodiment of the invention which is generally similar to that shown in FIG. 1. Corresponding numbers are used for corresponding parts with the additional designation "0.1". Platform 38.1 is shown in FIG. 2 in bottom plan. The platform consists of a sheet of rigid plastic with a series of stiffening ribs including ribs 70, 72, 74 and 76 on the outer perimeter, an X-shaped pair of ribs 78 and 80, parallel ribs 82 and 84 extending from front 49.1 to back 45.1 and a central rib 86 perpendicular thereto. The exact arrangement of ribs is not critical however. Portions of fibs 82 and 84 are broken away to show four slots 90, 92, 94 and 96 extending through the platform above the ribs.

There are also three pairs of shorter slots 89, 91 and 93 extending through the platform adjacent its two sides and near the center of its back. Slots 89 and 91 receive opposite ends of a strap 95, only one end of which is shown. Another such strap is received in slots 93. The straps are made of nylon webbing in this example, to serve as support members of this embodiment. Each end of strap 95 has a loop 97 to connect to the coat hooks in the manner shown FIG. 1. The strap through slots 93 has one such loop.

Cradle 50.1 is shown in FIG. 3 and is a single piece of corrugated cardboard in this embodiment provided with three fold lines 98, 100 and 102. The cradle is folded along lines 98 and 100 to form sides 50.1 and 52.1. The sides have tabs 104, 106, 108 and 110 which fit within the slots 90, 92, 94 and 96 respectively of the platform shown in FIG. 2 to connect the two components together. There is a flap 112 on the front of the cradle which has a mirror 114 connected thereto by adhesive. This provides a convenient mirror near eye level for the user.

FIG. 4 illustrates drawer 56.1 in flattened form. Again this is made of a single piece of cardboard, in this example with a series of fold lines 120, 122, 124 and 126 and double fold lines 128 and 130. Sides 136 and 138 of the drawer are formed by folding along lines 120 and 122. Flaps 140, 142, 144 and 146 are then bent at right angles to the sides. Back 134 is formed by folding along line 124 and along double fold line 128 over the flaps 140 and 144. Likewise the front is formed by folding along lines 126 and 130 over flaps 142 and 146 of the sides. Front 150 has a rectangular opening 152 which forms a recess on the top and front of the drawer when assembled to function as a handle. Once assembled, this embodiment is similar in function and appearance to the previous embodiment.

It should be noted that the locker shelf apparatus can also be adapted to fit lockers with a horizontal rod for hangers instead of hooks. In such an example the support members have hooks or other means for fitting about the rod.

It will be understood by someone skilled in the art that many of the features of the invention described above are by way of example only and are not intended to limit the scope of the invention which is to be interpreted with reference to the following claims.

What is claimed is:

1. A locker shelf apparatus, comprising:

a platform shaped to fit horizontally within a locker, the platform having a front, a back with a center and two opposite sides;

three support members connected to the platform at spaced-apart positions, the support members being elongated flexible tension members, two of the support members being connected to the platform adjacent each said side and a third said support member being connected to the platform adjacent the center of the back; and means on each said support member for engaging hooks in the locker above the platform.

2. An apparatus as claimed in claim 1, wherein the means on each said support member is a loop.

3. An apparatus as claimed in claim 1, wherein the platform has a drawer slidably mounted thereon.

4. An apparatus as claimed in claim 3, wherein the drawer is below the platform.

5. An apparatus as claimed in claim 4, wherein the platform has a bottom, a support cradle being connected to the bottom of the platform and having a horizontal member which is spaced-apart from the bottom of the platform, the drawer being between the horizontal member and the bottom of the platform.

6. An apparatus as claimed in claim 5, wherein the drawer and the cradle are of corrugated cardboard.

7. An apparatus as claimed in claim 1, wherein the platform is of rigid plastic.

8. A locker comprising:

a cabinet with an inside, a back, two sides, an open front and a door hingedly mounted on the front of the cabinet;

a coat hook mounted on each side of the cabinet and on the back of the cabinet inside the cabinet; and a shelf apparatus inside the cabinet including a platform shaped to fit horizontally within the cabinet, three support members connected to the platform at spaced-apart positions and means on each said support member for engaging the hooks in the cabinet above the platform.

9. A locker as claimed in claim 8, wherein the support members are elongated, flexible tension members.

10. A locker as claimed in claim 9, wherein the platform has a front, a back with a center and two opposite sides, two of the support members being connected to the platform adjacent each said side and a third said support member being connected to the platform adjacent the center of the back.

11. A locker as claimed in claim 9, wherein the means on each said support member is a loop.

12. A locker as claimed in claim 8, wherein the platform has a drawer slidably mounted thereon.

13. A locker as claimed in claim 12, wherein the drawer is below the platform.

14. A locker as claimed in claim 13, wherein the platform has a bottom, a support cradle being connected to the bottom of the platform and having a horizontal member which is spaced-apart from the bottom of the platform, the drawer being between the horizontal member and the bottom of the platform.

15. A locker as claimed in claim 14, wherein the drawer and the cradle are of corrugated cardboard.

16. A locker as claimed in claim 10, wherein the platform is of rigid plastic.

* * * * *